United States Patent [19]

Miller

[11] 4,387,530

[45] Jun. 14, 1983

[54] FLEXIBLE SHEET CONSTRUCTION SYSTEM

[75] Inventor: Ross Miller, Cambridge, Mass.

[73] Assignee: ProCreations, Inc., Brookline, Mass.

[21] Appl. No.: 232,395

[22] Filed: Feb. 9, 1981

[51] Int. Cl.[3] ..... A63H 9/00

[52] U.S. Cl. ..... 46/1 L; 46/156; 428/14

[58] Field of Search ..... 46/151, 157, 1 L, 22, 46/156; 2/89, 209.1, 213; 428/14

[56] References Cited

U.S. PATENT DOCUMENTS

| | | | |
|---|---|---|---|
| 703,245 | 6/1902 | Faulkner | 2/89 |
| 1,138,229 | 5/1915 | Knoblauch | 2/89 |
| 1,336,898 | 4/1920 | Flynn | 46/151 |
| 1,549,035 | 8/1925 | Van Laar | 46/151 |
| 1,648,282 | 11/1927 | Schneider | 2/213 |
| 2,450,326 | 9/1948 | Berger | 46/157 |
| 3,224,136 | 12/1965 | Moryl | 46/22 |
| 3,236,007 | 2/1966 | Abeson | 46/157 |
| 3,471,962 | 10/1969 | Klein | 46/157 |
| 3,789,547 | 2/1974 | Chemarin | 46/151 |

FOREIGN PATENT DOCUMENTS

| | | | |
|---|---|---|---|
| 2221422 | 11/1973 | Fed. Rep. of Germany | 46/151 |
| 583408 | 12/1946 | United Kingdom | 46/151 |
| 1289212 | 9/1972 | United Kingdom | 46/22 |

*Primary Examiner*—F. Barry Shay
*Attorney, Agent, or Firm*—Jerry Cohen

[57] ABSTRACT

A system for constructing a variety of organic forms including an elongated flexible sheet repeatedly 180° bendable about multiple crossing and spaced axes running through the sheet and with a longitudinal axis of symmetry and similar reentrants along edges of the sheet symmetrically arranged on two sides of the axis, fastening pairs with elements of each pair arranged symmetrically on opposite sides of the axis and further constructed in staggered form for transverse axis symmetry reassignment of fastener element pairs, the fastening elements being constructed and arranged for pair assignment and fastening in multiple combinations to define different organic forms, and the sheet being sufficiently stiff to produce in at least one of the organic form fastened together configurations, a self-supporting shape.

16 Claims, 13 Drawing Figures

FLEXIBLE SHEET CONSTRUCTION SYSTEM

BACKGROUND OF THE INVENTION

This invention relates to a system for constructing a variety of organic forms usable as toys, decorations and for educational purposes.

It is an object of this invention to provide a system for constructing a variety of organic forms which may be used for such purposes.

It is a further object of this invention to provide a system for constructing a variety of organic forms which may repeatedly be assembled and disassembled into multiple configurations.

It is a further object of this invention to provide the aforementioned system which is self-contained and easily assembled without tools.

It is a further object of this invention to provide the aforementioned system which is durable and safe to use.

It is a further object of this invention to provide the aforementioned system which maintains flat shape when disassembled, thus facilitating storage and transport.

It is a further object of this invention to provide the aforementioned system which holds both its constructed shape and its disassembled shape after repeated use.

SUMMARY OF THE INVENTION

This invention features a system for constructing a variety of organic forms and in particular animals having a flexible sheet repeatedly 180° bendable about multiple crossing and spaced axis running through the sheet and with a longitudinal axis of symmetry and similar re-entrants along edges of the sheet symmetrically arranged on two sides of the axis. Fastening means pairs are provided with elements of each pair arranged symmetrically on opposite sides of the axis and further constructed in staggered form for transverse axis symmetry reassignment of fastener element pairs. The fastening elements are constructed and arranged for assignment and fastening in multiple combinations to define different organic forms. The sheet is sufficiently stiff to produce a self-supporting shape.

In a preferred embodiment, the sheet comprises a laminate having a layer of foam interposed between two layers of fabric. The fabric may be velour or other furry material to simulate an animal's coat and may be solidly or multi-colored.

It is preferred that the fastening elements include complementary male and female interlocking lock snaps. Alternatively, the elements may comprise a contact sensitive reusable fastener such as Velcro or other suitable fastening means. The fastening elements may be carried by both sides of the sheet. Typically, the majority will be carried by one side although both sides may carry an equal number.

At least one pair of fastening elements may be backed by an organic form suggesting elements on the reverse side of the sheet. These elements are typically colored buttons which serve as eyes or other features of the constructed animal form.

In systems having a longitudinal axis of symmetry and pairs of fastening elements arranged symmetrically about that axis, the various pairs may have different spacings of their elements about the longitudinal axis. Alternatively, they may be equally spaced.

Other objects, features and advantages of the invention will be apparent from the following detailed description of preferred embodiments, taken with reference to the enclosed drawings in which,

BRIEF DESCRIPTION OF THE DRAWING

FIGS. 8 and 9 are similar views of subsequent steps in the construction of such a hare or tortoise from.

DETAILED DESCRIPTION OF PREFERRED EMBODIMENTS

Figure 1:
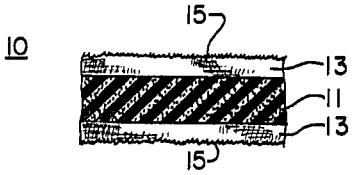
FIG. 1 is a side elevation cross-sectional view of a flexible sheet according to the invention.

A system for constructing a variety of organic, and in particular animal, forms comprises a flexible sheet 10, FIG. 1 of various sizes and shapes. Sheet 10 typically includes a foam interior 11, covered by a fabric exterior 13. This composition gives sheet 10 the flexibility needed for construction and enables sheet 10 to regain a flat form when disassembled. However, foam is sufficiently stiff to produce a self-supporting shape when sheet 10 is assembled. Fabric 13 may have a furry or fuzzy surface 15 to simulate an animal's coat and further may be solidly or multi-colored. The two variations of sheets described herein will be designated **10*a* and 10*b***.

Figure 2:
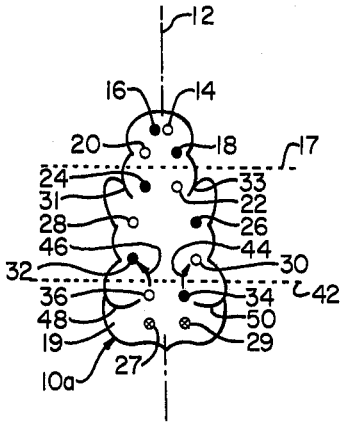
FIG. 2 is a top view of a disassembled system for constructing a variety of organic forms, according to this invention and of the initial steps in construction of a bear form from "bear form" sheet 10.

Disassembled, **10*a*, as shown in FIG. 2, includes a longitudinal axis of symmetry 12 and pairs of geometric lock snap fasteners with mating elements of each pair. For example, female snap 14 and male snap 16, arranged symmetrically on opposite sides of axis 12. Note that the complementing snap elements are equally arrayed on both sides of axis 12, i.e., there are equal numbers of snap elements on the left and right side of the axis. Male snap elements are designated by solid circles and female elements are indicated by open circles. Due to the aforementioned composition, sheet 10*a* is 180° bendable (either by folding or rolling) about axis 12** where the male and female elements of each pair may be snapped together. Backs of snaps of either kind are indicated by dashed circles.

Sheet **10*a* is similarly bendable about multiple transverse axis, such as 17, so that each element of the aforementioned fastening pairs may be reassigned with a symmetric mating element from another pair. For example, male snap 24 may be reassigned to snap into female snap 20, these two snap elements being symmetrically disposed about transverse axis 17, and female snap 22 likewise may receive male snap 18**.

The snap elements are carried primarily by side 19 of sheet 10*a*. However, some may protrude from the opposite obscured side. For example, the obscured snaps, which are backed by elements 27 and 29 (designated by "x" to distinguish from snaps). Note that pairs of snap elements (14–16, 18–20, etc.) disposed about longitudinal axis 12 are staggered, e.g., various pairs such as 14–16, 18–20 and 26–28 are spaced differently from axis 12. Re-entrant slits 31, 33, 48 and 50 are arranged symmetrically about axis 12.

To construct a bear configuration, sheet 10 is folded along transverse axis 42 in the direction of arrows 44 and 46: male snap 32 being inserted into female snap 36 and female snap 30 receiving male snap 34.

Figure 3:
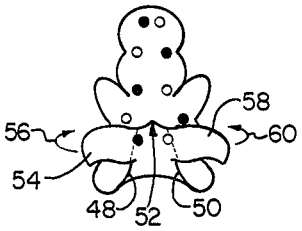
FIGS. 3–5 are similar views of subsequent steps in the construction of such a bear form.

Re-entrants 48 and 50, FIG. 3, permit upward folding of flap 52 about axis 51, appendage 54 being folded inwardly in the direction of arrow 56 and appendage 58 being likewise folded in the direction of arrow 60.

Figure 4:
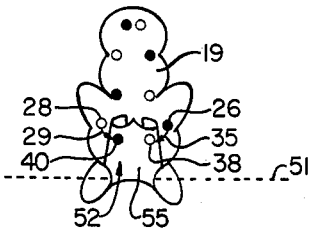

Folded flap 52, FIG. 4, is held in place typically by hand; snaps 38 and 40 carried by reverse side 55 of sheet 10*a*. Female snap 28 is drawn in the direction of arrow 29 to mate with male snap 40 while male snap 26 is drawn in the direction of arrow 35 to connect with female snap 38. In this manner, side 55 is made to directly connect with side 19.

Figure 5:
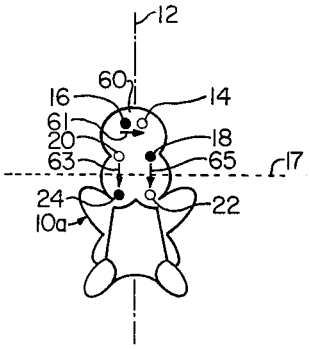

In FIG. 5, end 60 of sheet 10*a* is folded about axis 12 in the direction of arrow 61. Female snap 14 is connected with male snap 16. Sheet 10*a* is then folded about transverse axis 17 in the direction of arrows 63 and 65 so that male snap 24 may engage female snap 20 and male snap 18 may engage female snap 22.

Figure 6:
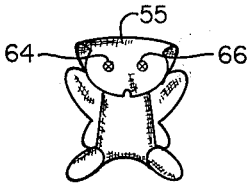
FIG. 6 is an isometric view of a fully constructed bear form.
Figure 7:
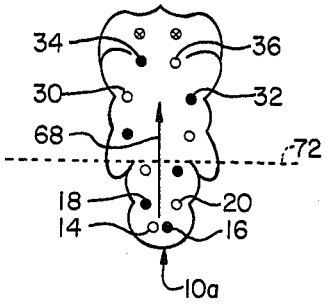
FIG. 7 is a view of the disassembled system of this invention and of the initial steps in constructing a hare or tortoise from the "bear form" sheet 10.
Figure 8:
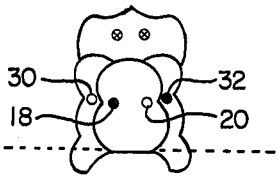

The fully constructed bear appears as in FIG. 6. Note that the bear form is self-supporting as discussed in conjunction with FIG. 1. Snaps 20 and 18 (previously shown in FIGS. 2–5) include backing buttons 64 and 66 respectively which are carried by side 55. These buttons are decorative elements in a variety of colors which serve the function of suggesting the bear's eyes. Similar such backing buttons may be included elsewhere, for example as previously described buttons 27 and 29 on side 19, backing snaps 38 and 40, thereby serving as eyes or other features for alternative creatures constructed by this system.

Such an alternative configuration may be made of sheet 10*a* as shown in FIGS. 7–10 in order to produce a tortoise or hare form. Note that sheet 10*a* has been disassembled (FIG. 7) and maintains its essentially flat shape. Sheet 10*a* is folded in the direction of arrow 68 along transverse axis 72. Female snap 14 and male snap 16 connect with male snap 34 and female snap 36 respectively. About the same axis 72, FIG. 8, male snap 18 and female snap 20 may be reassigned to female snap 30 and male snap 32 respectively (other snaps deleted for clarity).

Figure 9:
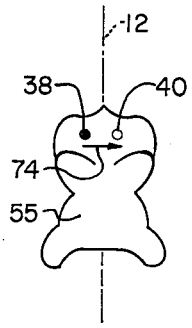
Figure 10:
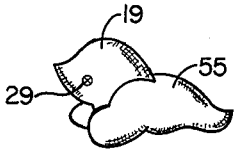
FIG. 10 is an isometric view of a completed hare or tortoise form.

Snaps 38 and 40, carried by side 55, FIG. 9, are drawn together in the direction of arrow 74 (sheet 10*a* being folded along axis 12) and connected. Snap 38 is backed on side 19 by decorative button 29, FIG. 10, and snap 40 is similarly backed by such a button (obscured in FIG. 10 but see button 27, FIG. 2). As heretofore described, these buttons constitute eyes. As shown in FIG. 10, the completed construction forms a tortoise or hare.

Figure 11:
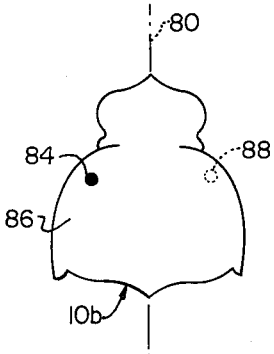
FIG. 11 is a view of an alternative disassembled system according to this invention and of the initial steps in constructing an owl form from an "owl form" sheet 10.
Figure 12:
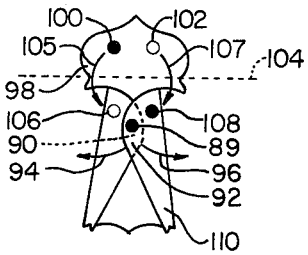
FIG. 12 is a similar view illustrating subsequent steps in the construction of such an owl form.

By utilizing alternative shaped sheets, such as 10*b*, FIG. 11, and alternative configurations of snap fasteners thereon, a wide variety of organic form combinations may be produced. An owl may be produced using sheet 10*b* having a longitudinal axis of symmetry 80. Snap 84 protrudes from side 86 and mating snap 88 protrudes from the obscured side. As shown in FIG. 12 folding end 90 over end 92 in the direction of arrows 94 and 96 snaps 84 and 88 may be snapped together at 89 at that point the back of snap 84 is shown in FIGS. 12 and 13.

Flap 98, carrying snaps 100 and 102 is folded about axis 104 in the direction of arrows 105 and 107; snap 100 being snap connected to mating snap 106 and snap 102 being similarly connected with snap 108, snaps 106 and 108 being carried by side 110 of sheet 10*b*.

Figure 13:
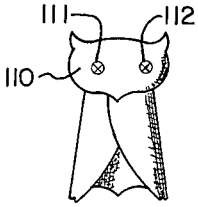
FIG. 13 is an isometric view of a completed owl form.

The completed owl is shown in FIG. 13. Backing buttons 111 and 112 of snaps 100 and 102 are carried by side 110 and serve as the owl's eyes as previously described.

It is evident that those skilled in the art, once given the benefit of the foregoing disclosure, may now make numerous other uses and modifications of, and departures from the specific embodiments described herein without departing from the inventive concepts. Consequently, the invention is to be construed as embracing each and every novel feature and novel combination of features present in, or possessed by, the apparatus and techniques herein disclosed and limited solely by the scope and spirit of the appended claims.

What is claimed is:

1. System for constructing a variety of simulated organic forms comprising, means defining an elongated flexible single sheet of abstract form repeatedly 180° bendable about multiple crossing and spaced axis running through the sheet and with an elongated longitudinal axis of symmetry and an outer edge contour having similar re-entrants along edges of the sheet symmetrically arranged on two sides of said longitudinal axis, fastening means pairs on said sheet including elements of each pair arranged symmetrically on opposite sides of said longitudinal axis and further constructed in staggered form for transverse axis symmetry reassignment of fastening element pairs, said fastening elements being constructed and arranged for pair assignment and fastening in multiple combinations to define different simulated organic forms, the elements of at least one of said fastening means pairs being backed by decorative organic-form-suggesting elements (e.g. eyes) on the reverse of said sheet, said sheet being sufficiently stiff to produce in at least one of said simulated organic form fastened-together combinations a self-supporting shape.

2. System in accordance with claim 1 wherein said fastening elements comprise interlocking lock snaps.

3. System in accordance with claims 1 or 2 wherein said fastening elements are arrayed equally on both sides of said sheet.

4. System in accordance with claim 1 wherein said sheet comprises a fabric-foam-fabric laminate.

5. System in accordance with claim 1 wherein some of the various pairs have different spacing of their elements about the longitudinal axis of symmetry.

6. System for constructing a variety of simulated organic forms comprising, means defining a flexible single sheet of abstract form repeatedly 180° bendable about multiple crossing and spaced axes running through the sheet, fastening means pairs having complementary mating elements arranged symmetrically on opposite sides of a central axis of said sheet, said fastening elements being constructed and arranged for pair assignment and fastening in multiple combinations to define different simulated organic forms, at least one of said fastening element pairs being symmetrically arranged with respect to said central axis and backed by decorative organic-form-suggesting elements (e.g. eyes) on the reverse side of said sheet, said sheet being sufficiently stiff to produce in at least one of said simulated organic form fastened-together combinations a self-supporting shape.

7. System in accordance with claim 6 wherein said fastening elements comprise interlocking lock snaps.

8. System in accordance with claim 6 wherein said fastening elements are situated symmetrically on opposite sides of said axes.

9. System in accordance with claims 6 or 7 wherein the fastening elements are arrayed primarily on one side of said sheet.

10. System in accordance with claims 6 or 7 wherein the fastening elements are arrayed equally on both sides of said object.

11. System in accordance with claim 6 wherein said sheet further includes similar re-entrants arrayed along the edges of said sheet.

12. System in accordance with claim 11 wherein said sheet includes a longitudinal axis of symmetry and said re-entrants are symmetrically arranged on two sides of said axis of symmetry.

13. System in accordance with claim 6 wherein the sheet comprises a fabric-foam-fabric laminate.

14. System in accordance with claim 6 wherein said sheet is elongated.

15. System in accordance with claim 14 wherein said sheet includes a longitudinal axis of symmetry.

16. System in accordance with claim 6 wherein elements of each fastening means pair are arranged symmetrically on opposite sides of said axis and further constructed in staggered form for transverse axis symmetry reassignment of fastener element pairs.

* * * * *